US010327532B2

(12) United States Patent
Li

(10) Patent No.: US 10,327,532 B2
(45) Date of Patent: Jun. 25, 2019

(54) COSMETIC CONTAINER

(71) Applicant: Shantou Kinhwa Plastic Industry Co., Ltd., Shantou, Guangdong (CN)

(72) Inventor: Weixiong Li, Guangdong (CN)

(73) Assignee: Shantou Kinhwa Plastic Industry Co., Ltd., Shantou (CN)

( * ) Notice: Subject to any disclaimer, the term of this patent is extended or adjusted under 35 U.S.C. 154(b) by 143 days.

(21) Appl. No.: 15/644,866

(22) Filed: Jul. 10, 2017

(65) Prior Publication Data

US 2018/0014625 A1 Jan. 18, 2018

(30) Foreign Application Priority Data

Jul. 15, 2016 (CN) ..... 2016 2 0743264 U

(51) Int. Cl.

| | |
|---|---|
| ***A45D 34/04*** | (2006.01) |
| ***A45D 40/00*** | (2006.01) |
| ***A45D 40/02*** | (2006.01) |
| ***A45D 40/12*** | (2006.01) |
| ***A45D 40/20*** | (2006.01) |

(52) U.S. Cl.

CPC ..... *A45D 40/02* (2013.01); *A45D 34/043* (2013.01); *A45D 40/00* (2013.01); *A45D 40/205* (2013.01); *A45D 40/12* (2013.01); *A45D 2040/0062* (2013.01)

(58) Field of Classification Search

CPC ..... A45D 40/02; A45D 40/12; A45D 40/205; A45D 40/00; A45D 40/20; A45D 2040/0062; A45D 34/043

See application file for complete search history.

(56) References Cited

U.S. PATENT DOCUMENTS

| | | | | | |
|---|---|---|---|---|---|
| 1,712,840 | A * | 5/1929 | Povel | A45D 40/02 | 401/55 |
| 2,441,017 | A * | 5/1948 | Garrett | A45D 40/02 | 132/316 |
| 2,529,037 | A * | 11/1950 | Marples | B43K 21/08 | 401/55 |
| 2,589,000 | A * | 3/1952 | Vani | A47G 21/005 | 401/12 |
| 2,609,922 | A * | 9/1952 | Book, Jr. | A45D 40/02 | 401/55 |
| 3,338,397 | A * | 8/1967 | Noyack | A45D 40/02 | 132/320 |
| 3,495,292 | A * | 2/1970 | Giba | B43L 19/0081 | 15/433 |

(Continued)

FOREIGN PATENT DOCUMENTS

| | | | | |
|---|---|---|---|---|
| GB | 890683 | A * | 3/1962 | A45D 40/04 |

*Primary Examiner* — Nicholas J. Weiss

(57) ABSTRACT

The present invention provides a cosmetic container comprising a body, and a rotating holder and a lifting holder which are disposed within the body, wherein the rotating holder is fixed inside the body, a gear partly protruding out of the rotating holder and the body is disposed within the rotating holder, and the lifting holder comprises a rack bar and a support holder for holding cosmetics, wherein the support holder is connected to an end of the rack bar closer to an opening part of the body, and the rack bar is vertically inserted in the rotating holder and is engaged with the gear. The cosmetic container has simple overall structure, and is capable of extending and retracting quickly and is convenient to use.

7 Claims, 7 Drawing Sheets

(56) References Cited

U.S. PATENT DOCUMENTS

| | | | | | |
|---|---|---|---|---|---|
| 3,728,034 | A * | 4/1973 | Winter | A45D 40/02 | 401/66 |
| 3,989,392 | A * | 11/1976 | Seidler | A45D 40/02 | 401/66 |
| 6,394,270 | B1 * | 5/2002 | Liu | A45D 40/02 | 206/385 |
| 7,097,375 | B1 * | 8/2006 | Bui | B43K 21/02 | 401/65 |
| 7,503,717 | B2 * | 3/2009 | Gutberlet | A45D 40/205 | 401/179 |
| 7,581,895 | B2 * | 9/2009 | Gutberlet | A45D 40/205 | 401/66 |
| 7,806,614 | B2 * | 10/2010 | Desson | A45D 40/24 | 401/179 |
| 8,152,397 | B2 * | 4/2012 | Gutberlet | A45D 40/02 | 401/172 |
| 8,342,764 | B2 * | 1/2013 | Bonneyrat | A45D 40/02 | 401/176 |
| 9,781,990 | B2 * | 10/2017 | Oh | A45D 40/02 | |
| 2010/0054842 | A1 * | 3/2010 | DeVito | A45D 40/02 | 401/81 |

* cited by examiner

COSMETIC CONTAINER

CROSS REFERENCE TO RELATED APPLICATIONS

The present application claims the benefit of Chinese Patent Application No. 201620743264.0 filed on Jul. 15, 2016. All the above are hereby incorporated by reference.

FIELD OF THE INVENTION

The present invention relates to a cosmetic container.

BACKGROUND OF THE INVENTION

Various makeup products are all provided with containers for accommodating cosmetic substances. Existing cosmetic containers are usually made in rotation-extrusion type. When needed for use, the rotating tube may be rotated to lift the cosmetic substances (e.g. lipstick, lip balm, etc.) accommodated in the body. Such configurations are substantially the same, which need the user to rotate the parts by two hands cooperatively and thus cannot be opened and used very quickly in case of emergency, leading to a defect of failing to meet the requirement of quickly use in different cases. In addition, after long-term use of the cosmetic container, inconvenient rotation may occur, or the cooperating rotating parts may get stuck, thereby resulting in non-smooth rotation during use and causing inconvenience to the user.

SUMMARY OF THE INVENTION

The present invention aims to solve the technical problems of existing cosmetic containers, including inconvenient use, un-capable of extending and retracting the cosmetic quickly for use, and complicated structure.

In order to solve the above mentioned technical problems, the present invention provides a cosmetic container, comprising a body, and a rotating holder and a lifting holder which are disposed within the body, wherein the rotating holder is fixed inside the body, a gear partly protruding out of the rotating holder and the body is disposed in the rotating holder, and the lifting holder comprises a rack bar and a support holder for holding cosmetics, wherein the support holder is connected to an end of the rack bar closer to an opening part of the body, and the rack bar is vertically inserted in the rotating holder and is engaged with the gear.

Alternatively, a lubricating device may be disposed at a back side of the rack bar, for lubricating the back side of the rack bar.

Alternatively, the lubricating device may be disposed inside the rotating holder.

Alternatively, the lubricating device may comprise a clamping piece fixed on the rotating holder and an oil cavity fixed on the clamping piece, wherein the oil cavity may have an outlet at a position corresponding to the back side of the rack bar.

Alternatively, a protrusion may be fixedly arranged on the rotating holder at a position opposing to the back side of the rack bar, and a first stop block and a second stop block which slidably fit the protrusion may be arranged in turn at the back side of the rack bar along its axis.

Furthermore, the first stop block may be a first bulge having an upper surface formed as curved surface and a lower surface formed as ramp surface, the second stop block may be a second bulge having an upper surface formed as ramp surface and a lower surface formed as curved surface.

Alternatively, the cosmetic container may further comprise a central tube fixedly arranged at the opening part of the body, and the support holder may be slidably arranged within the central tube.

Furthermore, a slide groove may be provided on inner wall of the central tube in a vertical direction, and the support holder may be arranged with a third stop block corresponding to the slide groove and slidably connected with the slide groove.

Furthermore, a stopper may be arranged at the end of the rack bar closer to the opening part of the body, and the stopper may be arranged at the bottom of the support holder.

Alternatively, the cosmetic container may further comprise a cap sleeved on the central tube and capping the body.

The present invention has advantages as follows.

The cosmetic container according to the present invention comprises the body, and the rotating holder and the lifting holder which are disposed within the body, wherein the rotating holder is fixed inside the body, the gear partly protruding out of the rotating holder and the body is disposed within the rotating holder, and the lifting holder comprises the rack bar and the support holder for holding cosmetics, wherein the support holder is connected to the end of the rack bar closer to an opening part of the body, and the rack bar is vertically inserted in the rotating holder and is engaged with the gear. In this case, as the gear is rotated to drive the rack bar to move upwards or downwards, the cosmetic held in the support holder may be quickly lifted for use. The entire device has a simple structure and reliable principle, and it effectively simplifies the means which employ the structure of rotating tube for motion transmission in existing cosmetic containers. When using the cosmetic container, the user may lift the cosmetics by single hand, which satisfies the user's requirement in different cases.

Furthermore, since the lubricating device is arranged at the back side of the rack bar for lubricating the back side of the rack bar, when the rack bar drives the support holder to slide upwards or downwards, the lubricating device may provide lubricating oil for the rack bar to reduce friction and increase resiliency, thereby facilitating more smooth and resilient upward or downward sliding of the rack bar and the lubricating device relative to each other. Since the lubricating device is disposed within the rotating holder and comprises the clamping piece fixed on the rotating holder and the oil cavity fixed on the clamping piece, the outlet of the oil cavity opposes to the back side of the rack bar, and the clamping piece is fixed within the rotating holder, the oil cavity may be fixedly maintained accordingly, thereby effectively facilitating a relative sliding between the rack bar and the lubricating device. Due to the oil cavity, the lubricating oil may remain effective even after long term storage, thereby facilitating more smooth sliding of the rack bar and increasing the service life of the device.

Furthermore, the protrusion is fixedly arranged on the rotating holder at a position opposing to the back side of the rack bar, and a first stop block and a second stop block which slidably fit the protrusion are arranged in turn at the back side of the rack bar along its axis. In the case that the support holder is activated upwards, the protrusion fits the first stop block, so that the user needs to apply a greater force to make the first stop block slide over the protrusion. Hence, when the pasty cosmetic is not in use, damage of the pasty cosmetic caused by unintentional upward and downward movement of the lifting holder is effectively prevented. In the case of filling cosmetics, the support holder needs to be lifted entirely and fixed at the top of the body. At this point, the protrusion fits the second stop block. In this case, in order to limit the support holder, the user needs to apply a greater force to make the stop device slide over the protrusion. Hence, the production loss caused by the automatic downward sliding and restoration of the support holder during filling is effectively prevented. Since the first stop block is the first bulge having the upper surface formed as curved surface and the lower surface formed as ramp surface, when the rack bar slides upwards, the protrusion fits the upper surface of the first stop block, thereby facilitating more smooth sliding and saving labour when driving the gear. Since the second stop block is the second bulge having the upper surface formed as ramp surface and the lower surface formed as curved surface, the protrusion fits the lower surface of the second stop block during filling, thereby facilitating more smooth sliding.

Furthermore, the cosmetic container further comprises the central tube fixedly arranged at the opening part of the body, and the support holder is slidably arranged within the central tube. The slide groove is provided on inner wall of the central tube in a vertical direction, and the support holder is arranged with the third stop block corresponding to the slide groove and slidably connected with the slide groove. During the upward and downward sliding of the support holder, the third stop block is always in position within the slide groove and thus the third stop block is always limited by the slide groove, thereby preventing the support holder from swaying during upward and downward sliding, ensuring internal transmission mechanism will not get loose, and decreasing the losses of the whole transmission mechanism. Since the stopper is arranged at the end of the rack bar closer to the opening part of the body and is disposed at the bottom of the support holder, the gear will be stopped by the stopper from moving further upwards when it moves to the stopper, whereby over-rotation of the gear is avoided, loss for the gear is reduced, and thus the entire transmission process is more reliable.

Furthermore, the cosmetic container further comprises the cap sleeved on the central tube and capping the body, whereby the cosmetic held in the support holder is effectively protected, and thus it may be used for a longer service life.

Figure 1:
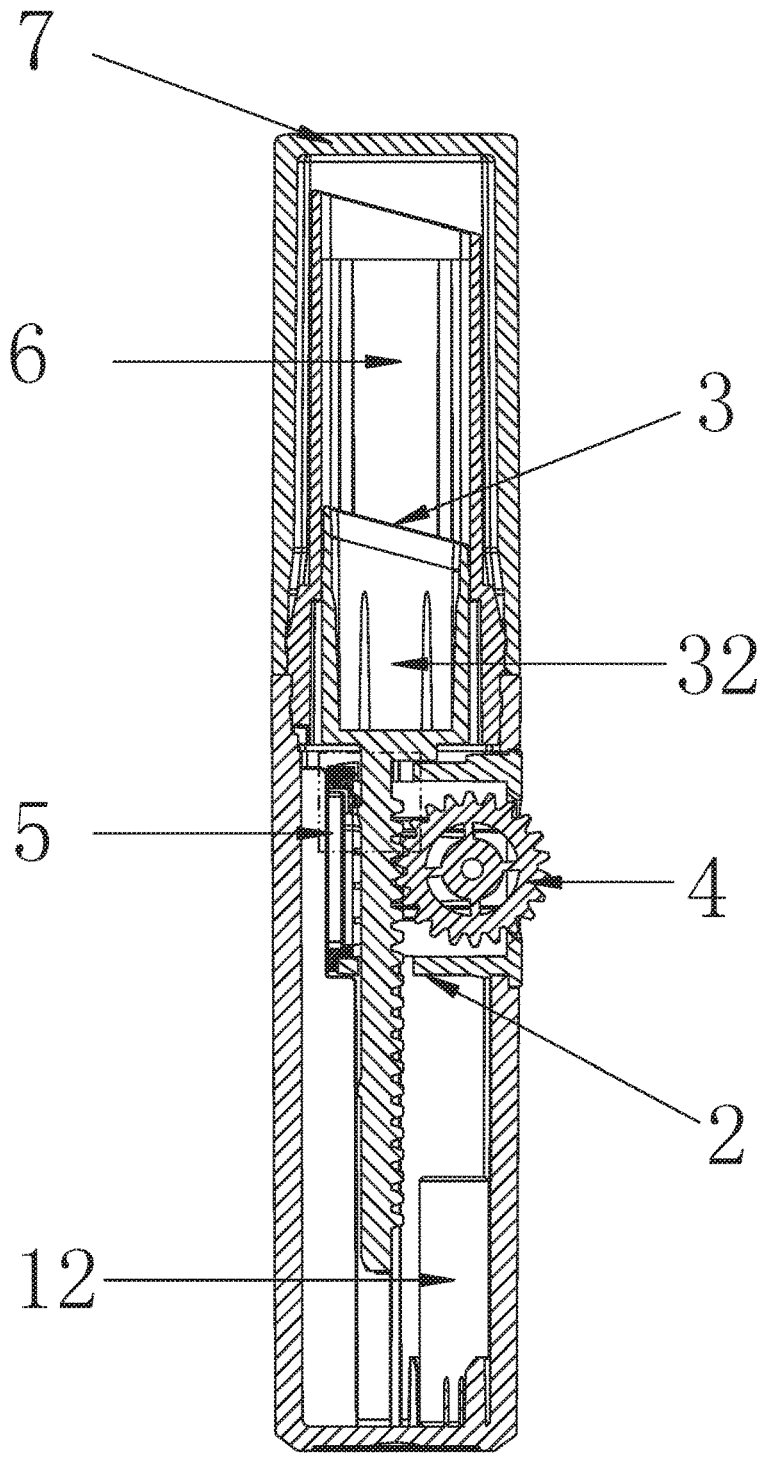
FIG. 1 is a schematic drawing of an integral structure of a cosmetic container according to an embodiment of the present invention.

Reference numerals are explained as follows.

1. body; 11. slot; 12. balance weight device; 2. rotating holder; 21. retaining hole; 3. lifting holder; 31. rack bar; 311. first stop block; 312. second stop block; 313. stopper; 32. support holder; 321. third stop block; 322. guiding block; 4. gear; 5. lubricating device; 51. clamping piece; 52. oil cavity; 53. protrusion; 6. central tube; 61. slide groove; 7. cap.

DETAILED DESCRIPTION OF ILLUSTRATED EMBODIMENTS

The technical solution according to an embodiment of the present invention will be clearly and completely explained below with reference to figures. It is evident that, the embodiments described herein are to be regarded as illustrative rather than restrictive. The present invention is intended to cover all embodiments those skilled in the art may obtain on the basis of the embodiments of the present invention without involving inventive step.

In the description, it should be understood that the terms such as "up" and "down" refer to position and orientation relationships in accordance with drawings, which are used for ease of simplify description, and are not intended to suggest or hint the particular position, or configuration and operation under the particular position of the mentioned devices or components. As such, it is intended that the foregoing be regarded as illustrative rather than limiting.

Referring to FIGS. 1-7, a cosmetic container according to a preferred embodiment of the present invention comprises a body 1, and a rotating holder 2 and a lifting holder 3 which are disposed within the body 1, the rotating holder 2 is fixed inside the body 1, a gear 4 partly protruding out of the rotating holder 2 and the body 1 is disposed in the rotating holder 2, and the lifting holder 3 comprises a rack bar 31 and a support holder 32 for holding cosmetics, wherein the support holder 32 is connected to an end of the rack bar 31 closer to an opening part of the body 1, and the rack bar 31 is vertically inserted in the rotating holder 2 and is engaged with the gear 4. The entire device has a simple structure and reliable principle of motion transmission. It is easy to use, and has a wide range of applications in particular in accommodating cosmetics such as lipsticks and eye creams, and it is easy to produce and manufacture.

According to such configuration, the rack bar 31 inserted in the rotating holder 2 is engaged with the gear 4 arranged in the rotating holder 2. The rotation of the gear 4 drives the rack bar 31 to extend or retract, and thereby drives the support holder 32 connected with the rack bar 31 to slide. A sidewall of the rotating holder 2 is provided with a retaining hole 21, through which the gear 4 protrudes out. The gear 4 protrudes through the retaining hole 21 and meanwhile protrudes out of the body 1, such that in the case the user uses such cosmetic container, it is convenient for the user to directly control the upward or downward rotation of the gear 4 which protrudes out of the body 1 by single hand, and thereby control the upward or downward sliding of the support holder 32 for accommodating cosmetics. It has a convenient process of using and a wide applicability.

Figure 2:
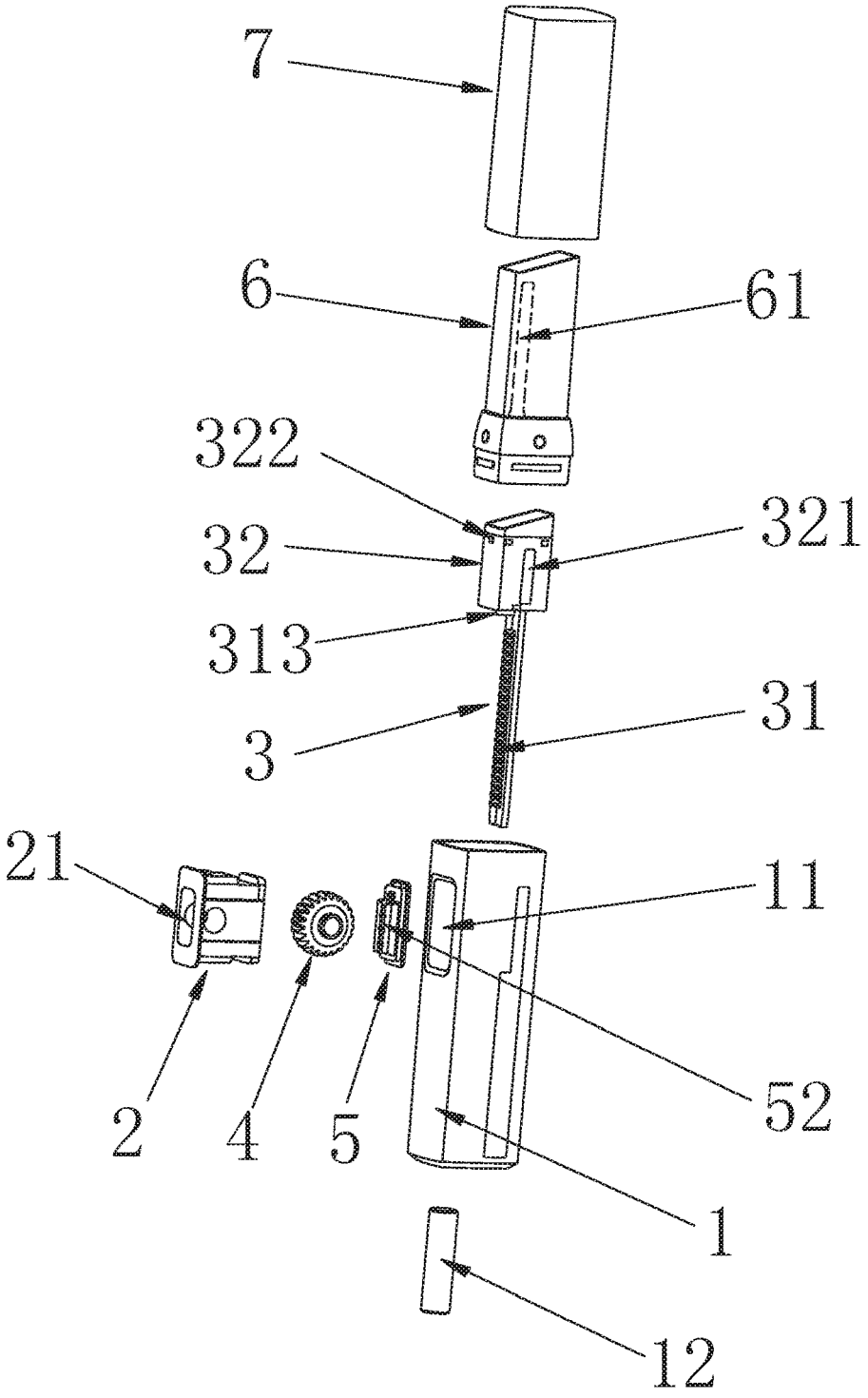
FIG. 2 is an exploded schematic view of a cosmetic container according to an embodiment of the present invention.
Figure 3:
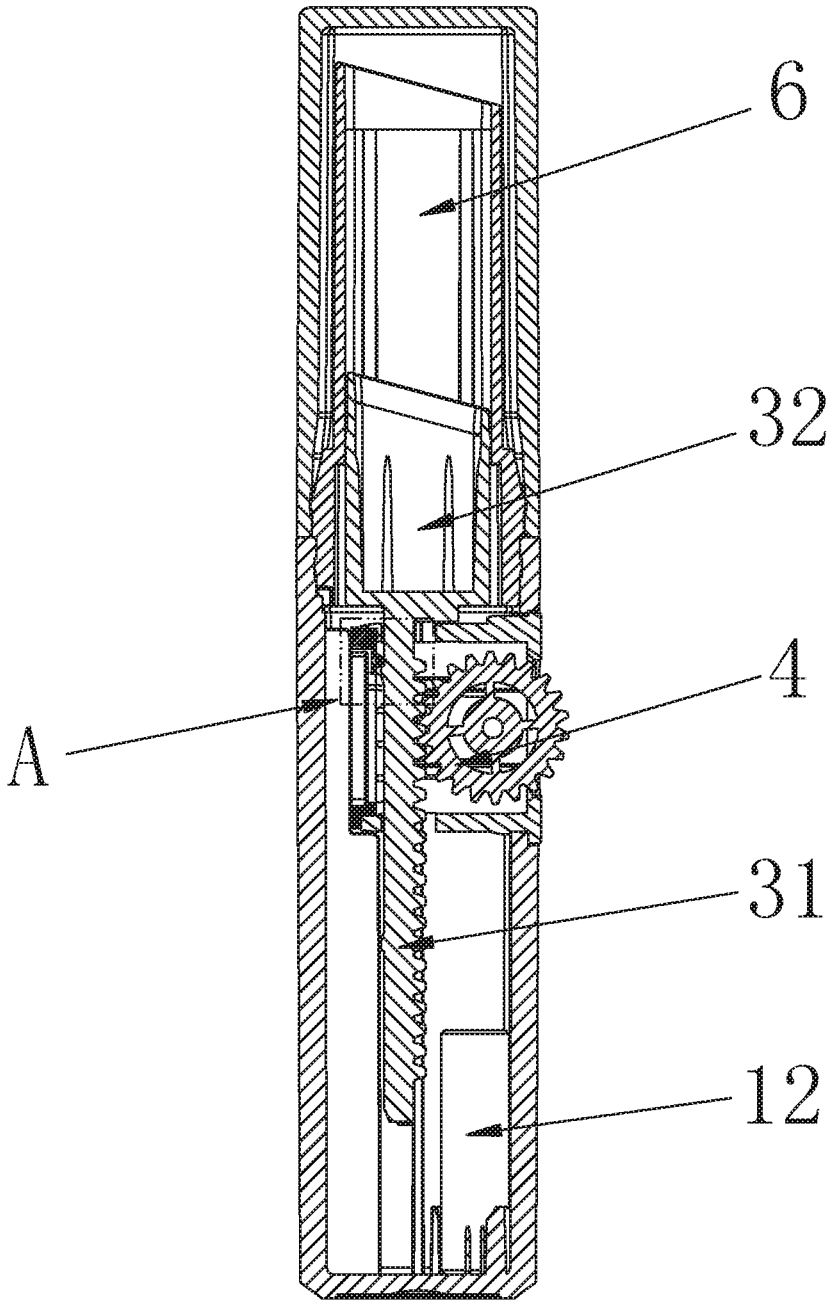
FIG. 3 is a schematic drawing of a cosmetic container according to an embodiment of the present invention under an original state.
Figure 4:
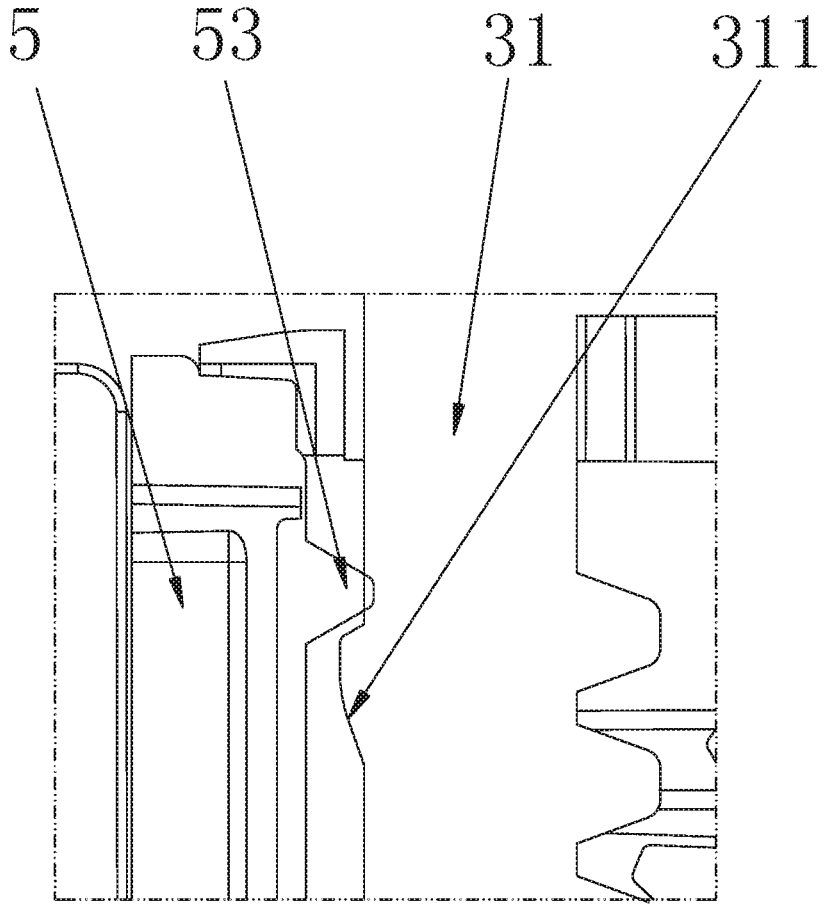
FIG. 4 is an enlarged schematic view of A part shown in FIG. 3.
Figure 5:
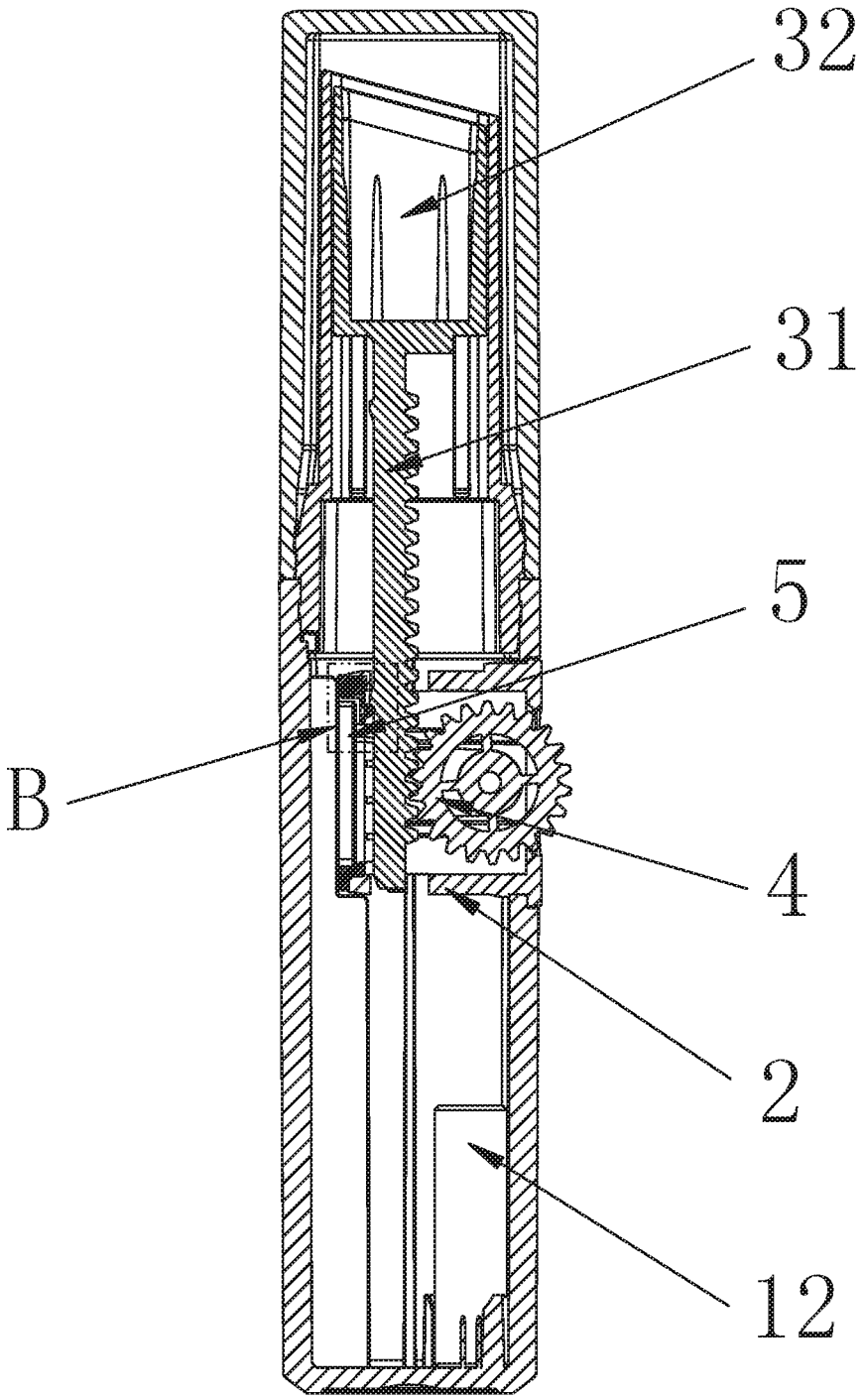
FIG. 5 is a schematic drawing of a cosmetic container according to an embodiment of the present invention under a working state.
Figure 6:
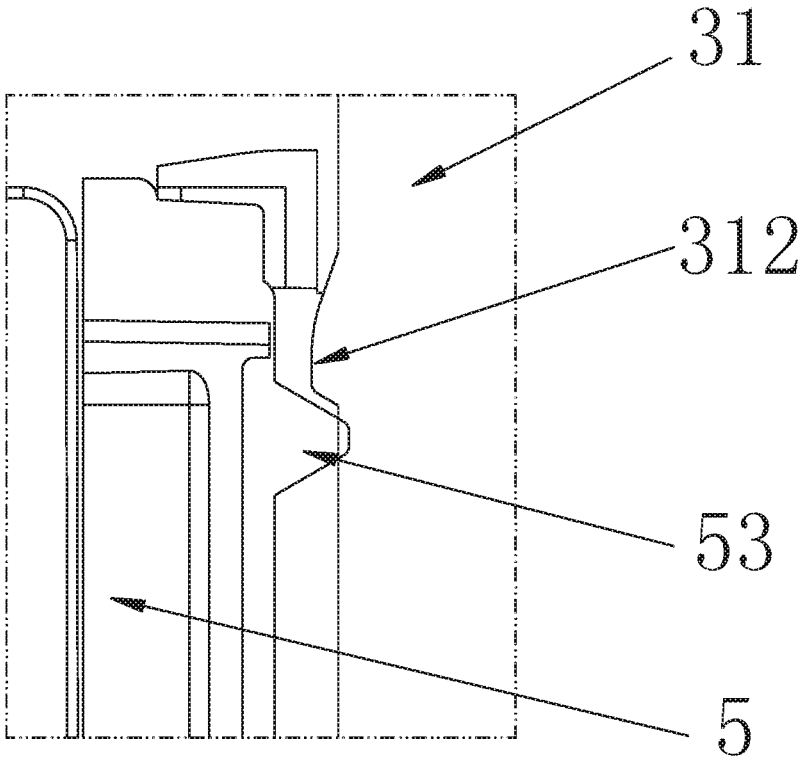
FIG. 6 is an enlarged schematic view of B part shown in FIG. 5.
Figure 7:
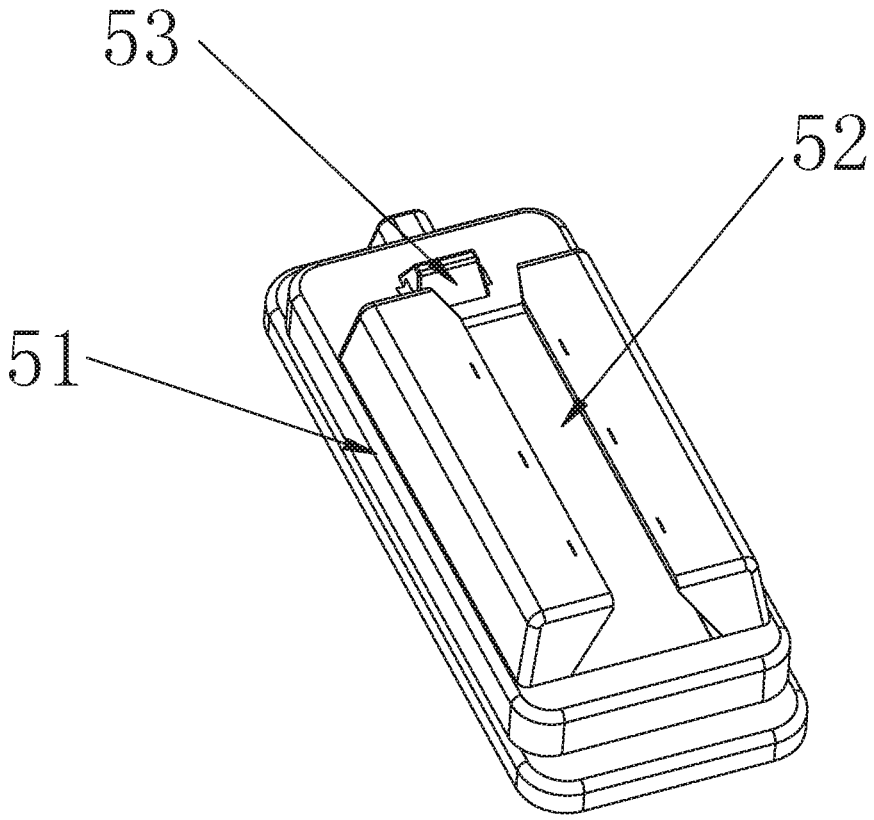
FIG. 7 is a schematic drawing of a lubricating device of a cosmetic container according to an embodiment of the present invention.

Therein, a slot 11 is provided on a sidewall of the body 1, and the rotating holder 2 is positioned in the slot 11, to allow the gear 4 to protrude through the retaining hole 21 and meanwhile protrudes out of the body 1. Due to the externally arranged gear 4, it is more convenient for the user to use, and it facilitates a more stable installation of the rotating holder 2 and smooth motion transmission of the gear 4. Referring to FIGS. 2, 7, a lubricating device 5 is arranged at the back side of the rack bar 31 for lubricating the back side of the rack bar 31. The lubricating device 5 is arranged inside the rotating holder 2 and comprises a clamping piece 51 fixed on the rotating holder 2 and an oil cavity 52 fixed on the clamping piece 51, wherein the oil cavity 52 has an outlet in the position corresponding to the back side of the rack bar 31. The lubricating device 5 provides lubricating oil for the rack bar 31, and the friction of the rack bar 31 is reduced and the resiliency of the rack bar 31 is increased due to the lubricating oil, thereby realizing protective effect during the upward or downward sliding of the lubricating device 5 and the rack bar 31 relative to each other, facilitating more smooth and resilient movement, preventing inconvenient rotation of the cosmetic container after long-term use, and effectively increasing service life of the device. The clamping piece 51 fixed on the rotating holder 2 and the oil cavity 52 fixed on the clamping piece 51 meet the requirements of the sliding of the rack bar 31 and the lubricating device 5 relative to each other. The oil cavity 52 supplies the lubricating oil directly to the back side of the rack bar 31, to facilitate a relative movement between the back side of the rack bar 31 and the lubricating device 5 during the upward or downward sliding of the support holder 32. In this case, a protection for the relative movement therebetween may be realized due to the lubricating oil supplied to the back side of the rack bar 31. In addition, due to the oil cavity 52, the lubricating oil may remain effective even after long term storage, which facilitates a long-term use of the cosmetic container. The entire lubricating device 5 has a very simple structure and reliable process of using. It should be noted that, the lubricating device 5 is fixedly arranged at the back side of the rack bar 31, and a tapered structure is arranged at the back side of the rack bar 31 in the present embodiment, wherein the clamping piece 51 of the lubricating device 5 has a structure matching with the tapered structure. The clamping piece 51 is disposed in the tapered structure, and the clamping piece 51 and the back side of the rack bar 31 are fixedly connected with each other by pin-fitting. However, without being limited to the present embodiment, the clamping piece 51 and the back side of the rack bar 31 may be fixed by welding or other connecting ways in other embodiments.

Referring to FIGS. 3-6, a protrusion 53 is fixedly arranged on the clamping piece 51 of the lubricating device 5 at a position opposing to the back side of the rack bar 31, and a first stop block 311 and a second stop block 312 which slidably fit the protrusion 53 are arranged in turn at the back side of the rack bar 31 along its axis. When the lifting holder 3 is activated, the first stop block 311 is positioned below the protrusion 53. In this case, in order to make the rack bar 31 move upwardly to lift the support holder 32, the user needs to apply a greater force to rotate the gear 4 downwardly and make the first stop block 311 slide over the protrusion 53 and then slide upwards. In this way, when the pasty cosmetic is not in use, in particular when the cosmetic container is usually put into the handbag by the female user, damage of the pasty cosmetic caused by unintentional upward and downward movement of the lifting holder 3 is effectively prevented, thereby realizing better protection for the pasty cosmetic. In the case of filling pasty cosmetics, the lifting holder 3 needs to be positioned at the top of the body 1, and meanwhile the second stop block 312 is positioned above the protrusion 53. In this case, the protrusion 53 holds up the second stop block 312, and the user needs to apply a greater force to rotate the gear 4 upwardly and make the second stop block 312 slide over the protrusion 53. In this way, In the case of filling cosmetics, the production loss caused by the automatic downward sliding and restoration of the lifting holder 3 is effectively prevented, and the workload of the producer is reduced because the producer doesn't need to control the movement of the gear 4 all the time during filling to make sure the lifting holder 3 won't slide down. Furthermore, the first stop block 311, the second stop block 312, and the protrusion 53 have very simple structures and very reliable coordinated motion, and are convenient to produce and use. Therein, the first stop block 311 is a first bulge which is provided on the back side of the rack bar 31 and has an upper surface formed as curved surface and a lower surface formed as ramp surface. When the user starts to use the cosmetic, the protrusion 53 is positioned above the first stop block 311, and the user needs to apply a force on the gear 4 to enable the first stop block 311 provided on the back side of the rack bar 31 to slide over the protrusion 53. In this case, the upper surface formed as curved surface facilitates a relative sliding between the first stop block 311 and the protrusion 53. The second stop block 312 is a second bulge which is provided on the back side of the rack bar and has an upper surface formed as ramp surface and a lower surface formed as curved surface. In the case of filling the support holder 32 of the cosmetic container, the protrusion is positioned below the second stop block 312, and then after the filling, the gear 4 is driven to enable the second stop block 312 provided on the back side of the rack bar to slide over the protrusion 53. In this case, the lower surface formed as curved surface facilitates a relative sliding between the second stop block 312 and the protrusion 53.

Furthermore, the cosmetic container further comprises a central tube 6 fixedly arranged at the opening part, and the support holder 32 is slidably arranged within the central tube 6. A slide groove 61 is provided on inner wall of the central tube 6 in a vertical direction, and the support holder 32 is arranged with a third stop block 321 corresponding to the slide groove 61 and slidably connected with the slide groove 61. During the upward and downward sliding of the lifting holder 3, the third stop block 321 is always in position within the slide groove 61 and thus the movement path of the third stop block 321 is always limited by the slide groove 61, thereby ensuring the lifting holder 3 will not get loose during moving, effectively preventing the lifting holder 3 from swaying too much to result in a release of connection, and increasing service life of the device. Referring to FIG. 2, the rack bar 31 is connected to the support holder 32 at the end of the rack bar 31 closer to the opening part of the body 1, and a stopper 313 is arranged at the end of the rack bar 31 closer to the opening part of the body 1. During the moving of the gear 4 and the rack bar 31 engaged with each other, once the gear 4 is engaged to the upper end of the rack bar 31, the movement will be stopped by the stopper 313 and thus further upward movement and over-rotation of the gear 4 relative to the rack bar 31 are avoided, thereby preventing over-use and damage of the gear 4. The support holder 32 is arranged with guiding blocks 322 on the sidewall at its upper end. Due to the guiding blocks 322, certain frictions are created when the support holder 32 slides upwards or downwards inside the central tube 6, such that unintentional upward and downward movement of the support holder 32 during sliding within the central tube 6 is effectively prevented.

Referring to FIGS. 1-2, the cosmetic container according to the preferred embodiment further comprises a cap 7 externally sleeved on the central tube 6 and capping the body 1, and a balance weight device 12 is mounted on the bottom of the body 1. Due to the cap 7, the cosmetic container is effectively protected from contamination from the surrounding, and thus the cosmetics will be maintained clean and hygienic and suitable for long-term use. The balance weight device 12 mounted on the bottom of the body 1 may be a balance weight iron or other devices. Due to the balance weight device 12, the true weight of the entire device is increased, which makes it easier to place the cosmetic container in vertical direction and keep balance, so that it is easy to place.

It should be noted that, although the cosmetic container in the present embodiment has a cuboid shape, it is not limited by the present embodiment and in other embodiments may have any appropriate shape such as cylinder shape according to the actual needs.

The assembling method for the cosmetic container according to the preferred embodiment is as follows. At first, mounting the balance weight device 12 on the bottom of the body 1, assembling the gear 4 within the rotating holder 2 in such a manner that the gear 4 protrudes out from the retaining hole 21 provided on the rotating holder 2, assembling the entire rotating holder 2 in the slot 11 provided on the sidewall of the body 1 in such a manner that the gear 4 which protrudes out faces outward, fixedly connecting the support holder 32 to the end of the rack bar 31 closer to the opening part of the body 1, fixedly connecting the lubricating device 5 to the back side of the rack bar 31 in such a manner that the outlet of the oil cavity 52 of the lubricating device 5 opposites to the back side of the rack bar 31, then inserting the rack bar 31 into the rotating holder 2 to enable the gear 4 to engage with the rack bar 31 and allow the lubricating device 5 mounted on the back side of the rack bar 31 to be positioned within the rotating holder 2, after that sleeving the central tube 6 on the support holder 32 externally in such a manner that the central tube 6 is positioned at the opening part of the body 1, assembling and fitting the support holder 32 and the central tube 6 in such a manner that the third stop block 321 provided on the support holder 32 is positioned in the slide groove 61 provided on the inner wall of the central tube 6, and finally externally sleeving the cap 7 on the central tube 6 and closing the body 1 with the cap 7.

The cosmetic container according to the present invention comprises the body, and the rotating holder and the lifting holder which are disposed within the body, wherein the rotating holder is fixed inside the body, the gear partly protruding out of the rotating holder and the body is disposed within the rotating holder, and the lifting holder comprises the rack bar and the support holder for holding cosmetics, wherein the support holder is connected to the end of the rack bar closer to an opening part of the body, and the rack bar is vertically inserted in the rotating holder and is engaged with the gear. In this case, as the gear is rotated to drive the rack bar to move upwards or downwards, the cosmetics held in the support holder are quickly lifted for use. The entire device has a simple structure and reliable principle, and it effectively simplifies the means which employ the structure of rotating tube for motion transmission in existing cosmetic containers. When using the cosmetic container, the user may lift the cosmetics by single hand, which satisfies the user's requirement in different cases.

It should be understood that, in the present invention, terms such as "the first" and "the second" used herein for indicating various parts are merely intended to distinguish same type of parts from one another, but are not necessarily limited to these terms. For example, terms "the first" part may be referred to as "the second" part, and similarly, "the second" part may be referred to as "the first" part, without departing from the scope of the present invention.

All the above are merely the preferred embodiments of the present invention. It should be noted that, those skilled in the art may obtain changes and various modifications included within the principle and the scope of the present invention.

The invention claimed is:

1. A cosmetic container, characterized in that: the cosmetic container comprises a body (1), and a rotating holder (2) and a lifting holder (3) which are disposed within the body (1), wherein the rotating holder (2) is fixedly arranged inside the body (1), a gear (4) is disposed in the rotating holder (2) and partly protrudes out of the rotating holder (2) and out of the body (1), wherein the lifting holder (3) comprises a rack bar (31) and a support holder (32) for holding cosmetic, wherein the support holder (32) is connected to an end of the rack bar (31) proximal to an opening part of the body (1), and the rack bar (31) is vertically arranged in the rotating holder (2) and is engaged with the gear (4), a lubricating device (5) for lubricating a back side of the rack bar (31) is disposed at the back side of the rack bar (31) within the rotating holder (2), and the lubricating device (5) comprises a clamping piece (51) fixedly arranged on the rotating holder (2) and an oil cavity (52) fixedly arranged on the clamping piece (51), wherein the oil cavity (52) has an outlet disposed at a position opposite to the back side of the rack bar (31).

2. The cosmetic container according to claim 1, characterized in that: the rotating holder (2) is fixedly arranged with a protrusion (53) at a position opposite to the back side of the rack bar (31), and a first stop block (311) and a second stop block (312) which slidably fit the protrusion (53) are arranged in turn at the back side of the rack bar (31) along an axis of the rack bar (31).

3. The cosmetic container according to claim 2, characterized in that: the first stop block (311) is a first bulge having an upper surface formed as a curved surface and a lower surface formed as a ramp surface, and the second stop block (312) is a second bulge having an upper surface formed as a ramp surface and a lower surface formed as a curved surface.

4. The cosmetic container according to claim 1, characterized in that: the cosmetic container further comprises a central tube (6) fixedly arranged at the opening part of the body (1), and the support holder (32) is slidably arranged within the central tube (6).

5. The cosmetic container according to claim 4, characterized in that: a slide groove (61) is vertically provided on an inner wall of the central tube (6), and the support holder (32) is arranged with a third stop block (321) corresponding to the slide groove (61) and slidably connected with the slide groove (61).

6. The cosmetic container according to claim 4, characterized in that: a stopper (313) is arranged at the end of the rack bar (31) proximal to the opening part of the body (1), and the stopper (313) is disposed at the bottom of the support holder (32).

7. The cosmetic container according to claim 4, characterized in that: the cosmetic container further comprises a cap (7) and the cap (7) is sleeved on the central tube (6) to close the body (1).

* * * * *